US010557251B2

(12) United States Patent
Imura et al.

(10) Patent No.: US 10,557,251 B2
(45) Date of Patent: Feb. 11, 2020

(54) WORK MACHINE

(71) Applicant: HITACHI CONSTRUCTION MACHINERY CO., LTD., Tokyo (JP)

(72) Inventors: Shinya Imura, Toride (JP); Shinji Nishikawa, Kasumigaura (JP); Manabu Edamura, Kasumigaura (JP); Kouji Ishikawa, Kasumigaura (JP); Masatoshi Hoshino, Tsuchiura (JP); Shinji Ishihara, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 140 days.

(21) Appl. No.: 15/554,316

(22) PCT Filed: Mar. 10, 2016

(86) PCT No.: PCT/JP2016/057681
§ 371 (c)(1),
(2) Date: Aug. 29, 2017

(87) PCT Pub. No.: WO2017/154187
PCT Pub. Date: Sep. 14, 2017

(65) Prior Publication Data
US 2018/0163374 A1 Jun. 14, 2018

(51) Int. Cl.
*E02F 9/22* (2006.01)
*E02F 9/20* (2006.01)
(Continued)

(52) U.S. Cl.
CPC ..... *E02F 9/2235* (2013.01); *E02F 9/2004* (2013.01); *E02F 9/2246* (2013.01);
(Continued)

(58) Field of Classification Search
CPC ..... E02F 9/2235; E02F 9/2004; E02F 9/2246; E02F 9/2271; E02F 9/2292; E02F 9/2296;
(Continued)

(56) References Cited

U.S. PATENT DOCUMENTS

2008/0299847 A1* 12/2008 Kaji ..... B63H 21/213 440/87

FOREIGN PATENT DOCUMENTS

JP 11-166482 A 6/1999
JP 2008-169796 A 7/2008
(Continued)

OTHER PUBLICATIONS

International Search Report of PCT/JP2016/057681 dated Apr. 5, 2016.
(Continued)

*Primary Examiner* — Anthony R Jimenez
(74) *Attorney, Agent, or Firm* — Mattingly & Malur, PC

(57) ABSTRACT

The first engine speed or a work machine is higher than the minimum engine speed, and the second engine speed is higher than the first engine speed and lower than the maximum engine speed. The ratio of the change in the target engine speed to the change in the operation amount of the engine speed instructing device when the operation amount of the engine speed instructing device is changed from the operation amount for instructing the minimum speed to the operation amount for instructing the first engine speed is larger than the ratio of the change in the target engine speed to the change in the operation amount of the engine speed instructing device when the operation amount of the engine speed instructing device is changed from the operation amount for instructing the second engine speed to the operation amount for instructing the maximum speed.

2 Claims, 8 Drawing Sheets

(51) Int. Cl.

| | |
|---|---|
| ***F15B 13/042*** | (2006.01) |
| ***F02D 31/00*** | (2006.01) |
| ***F02D 29/04*** | (2006.01) |
| ***F02D 41/02*** | (2006.01) |

(52) U.S. Cl.
CPC ..... *E02F 9/2271* (2013.01); *E02F 9/2296* (2013.01); *F15B 13/042* (2013.01)

(58) Field of Classification Search
CPC ..... F02D 31/007; F02D 29/04; F02D 41/021; F02D 2200/024; F02D 2200/1001; F02D 2200/60; F15B 13/042; G06F 19/00
USPC ..... 701/50
See application file for complete search history.

(56) References Cited

FOREIGN PATENT DOCUMENTS

| | | | |
|---|---|---|---|
| JP | 4136041 | B2 | 8/2008 |
| JP | 2009-008072 | A | 1/2009 |
| JP | 2011-157751 | A | 8/2011 |

OTHER PUBLICATIONS

International Preliminary Report on Patentability received in corresponding International Application No. PCT/JP2016/057681 dated Sep. 20, 2018.

* cited by examiner

WORK MACHINE

TECHNICAL FIELD

The present invention relates to work machines and particularly to a work machine in which the operator can specify an engine speed using an engine speed instructing device such as an engine control dial (hereinafter referred to as the EC dial) or the like.

BACKGROUND ART

A work machine, such as a hydraulic excavator, is known in which a hydraulic pump is driven by the power of an engine and the hydraulic fluid discharged from the hydraulic pump is used to drive hydraulic actuators. Generally, in such work machines, the operator operates the EC dial to determine an engine speed and operates operation levers to determine the speed and power of each hydraulic actuator.

For example, there is a work machine with a heavy load work mode, a normal work mode, and an economy mode for saving fuel (see FIG. 5 of Patent Document 1). In the work machine, the engine speed can be set to any value between the minimum speed and the maximum speed determined for each mode by the EC dial.

There is also a work machine in which the EC dial is used to determine a target engine speed, the engine is controlled such that its speed reaches the target engine speed, and the hydraulic pump is controlled such that the pump absorption torque corresponding to the engine speed is achieved. This EC dial can instruct any target speed, and the pump absorption torque is adjusted accordingly to any value desired (see, for example, FIG. 6 of Patent Document 2).

There is another work machine that determines the target engine speed to any speed excluding a preset speed range for the purpose of preventing resonance resulting from particular engine speeds (see FIGS. 4 and 5 of Patent Document 3).

PRIOR ART DOCUMENTS

Patent Documents

Patent Document 1: JP-2011-157751-A
Patent Document 2: Japanese Patent No. 4136041
Patent Document 3: JP-2008-169796-A

SUMMARY OF THE INVENTION

Problem to be Solved by the Invention

In the method of using the EC dial to set the engine speed to any speed between the minimum speed and the maximum speed as in the methods of Patent Documents 1 and 2, if there is a mechanical resonance-inducing speed range in the range in which the engine speed can be set, setting the engine speed in the vicinity of mechanical resonance frequencies may cause resonance, and generate large oscillation.

By contrast, according to the method of Patent Document 3, resonance resulting from particular engine speeds can be prevented. However, while a typical work machine is often required to perform fine adjustments of the engine speed in a high speed range in which output power is also high, the method of Patent Document 3 is such that the slope in the range from the upper limit (Rhmin in FIGS. 4 and 5 of Patent Document 3) of the excluded preset speed range to the upper limit (Rmax) of the target speed with respect to the output voltage is not gentle. Thus, it is difficult to finely adjust the engine speed near the upper limit of the excluded set speed range.

Further, some engines have a speed-torque characteristics that a speed decrease results in a drastic torque decrease in a particular speed range such as the one illustrated in FIG. 18. Such an engine can be applied to an hydraulic excavator. In that case, the engine is prone to lug down when the engine speed is set by the EC dial in the vicinity of a speed range (range from Na to Nb) between the minimum speed N1 and the maximum speed N2 where a speed decrease results in a drastic torque decrease.

The invention has been contrived in view of the above, and its object is to provide a work machine including an engine speed control device that makes resonance and engine lug down less likely to occur even if the speed-torque characteristics of the engine are such that there is a speed range where an engine speed decrease results in a drastic torque decrease or a mechanical resonance-inducing speed range between a minimum speed and a maximum speed and also allows fine adjustments of the engine speed in a high speed range.

Means for Solving the Problem

To achieve the above object, a first aspect of the invention is a work machine including: an engine; a hydraulic pump driven by the engine; a hydraulic actuator driven by hydraulic fluid discharged from the hydraulic pump; an engine speed instructing device for an operator to instruct a target engine speed for the engine; and a control device for controlling an engine speed of the engine. The control device includes a target engine speed computing section for detecting an operation amount of the engine speed instructing device and computing the target engine speed based on target engine speed characteristics preset from the detected operation amount of the engine speed instructing device. The target engine speed characteristics are such that the target engine speed can be set excluding a range between a first engine speed and a second engine speed, the first engine speed being higher than a minimum speed of the engine and lower than a maximum speed of the engine, the second engine speed being higher than the first engine speed and lower than the maximum speed of the engine. A ratio of a change in the target engine speed to a change in the operation amount of the engine speed instructing device when the operation amount of the engine speed instructing device is changed from an operation amount for instructing the minimum speed to an operation amount for instructing the first engine speed is larger than a ratio of a change in the target engine speed to a change in the operation amount of the engine speed instructing device when the operation amount of the engine speed instructing device is changed from an operation amount for instructing the second engine speed to an operation amount for instructing the maximum speed.

Effect of the Invention

In accordance with the invention, resonance and engine lug down are less likely to occur even if there is a mechanical resonance-inducing speed range or a speed range where an engine speed decrease results in a drastic torque decrease between a minimum speed and a maximum speed of the engine speed. Further, because the engine speed can be finely adjusted in a speed range higher than a particular engine speed, it is possible to improve work efficiency in the speed range frequently used in the work machine.

MODES FOR CARRYING OUT THE INVENTION

A work machine according to an embodiment of the present invention will now be described with reference to the accompanying drawings. A hydraulic excavator is used as an example of the work machine. It should be noted that the invention is not limited to hydraulic excavators but is applicable to any work machine as long as the operator can specify an engine speed using an engine speed instructing device such as an EC dial or the like.

Figure 1:
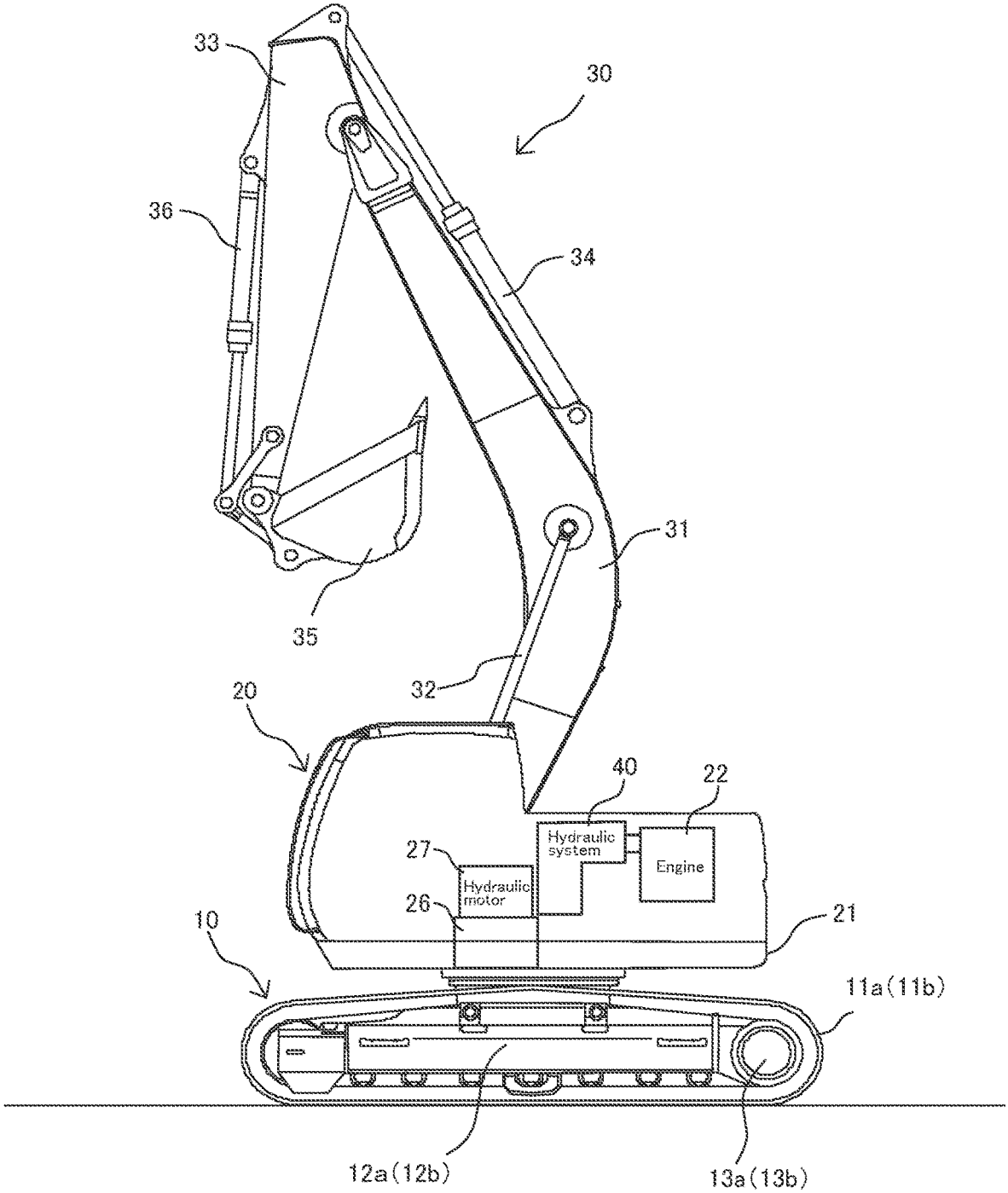
FIG. 1 is a perspective view of a hydraulic excavator which is an embodiment of a work machine according to the invention.

FIG. 1 is a perspective view of the hydraulic excavator which is the embodiment of the work machine according to the invention. As illustrated in FIG. 1, the hydraulic excavator includes a lower travel structure 10, an upper swing structure 20 provided atop the lower travel structure 10 in a swingable manner, and an excavating mechanism 30 attached to the upper swing structure 20.

The lower travel structure 10 includes a pair of crawlers 11*a* and 11*b*, a pair of crawler frames 12*a* and 12*b* (only one side is illustrated in FIG. 1), a pair of hydraulic travel motors 13*a* and 13*b* for driving the crawlers 11*a* and 11*b* independently, decelerating mechanisms, and the like.

The upper swing structure 20 includes a swing frame 21; an engine 22 as a prime mover, provided on the swing frame 21; a hydraulic swing motor 27; a decelerating mechanism 26 for decelerating the rotation of the hydraulic swing motor 27; and the like. The drive power of the hydraulic swing motor 27 is transmitted via the decelerating mechanism 26, and the transmitted power is used to swing the upper swing structure 20 (swing frame 21) relative to the lower travel structure 10.

The excavating mechanism (front device) 30 is installed on the upper swing structure 20. The excavating mechanism 30 includes a boom 31; a boom cylinder 32 for driving the boom 31; an arm 33 supported pivotably near the distal end of the boom 31; an arm cylinder 34 for driving the arm 33; a bucket 35 supported pivotably at the distal end of the arm 33; a bucket cylinder 36 for driving the bucket 35; and the like.

Also, a hydraulic system 40 is installed on the swing frame 21 of the upper swing structure 20. The hydraulic system 40 is used to drive hydraulic actuators including the above-described hydraulic travel motors 13*a* and 13*b*, hydraulic swing motor 27, boom cylinder 32, arm cylinder 34, and bucket cylinder 36.

The hydraulic system 40 includes hydraulic pumps, regulators, a control valve, and the like, the details of which are described below with reference to FIG. 2.

Figure 2:
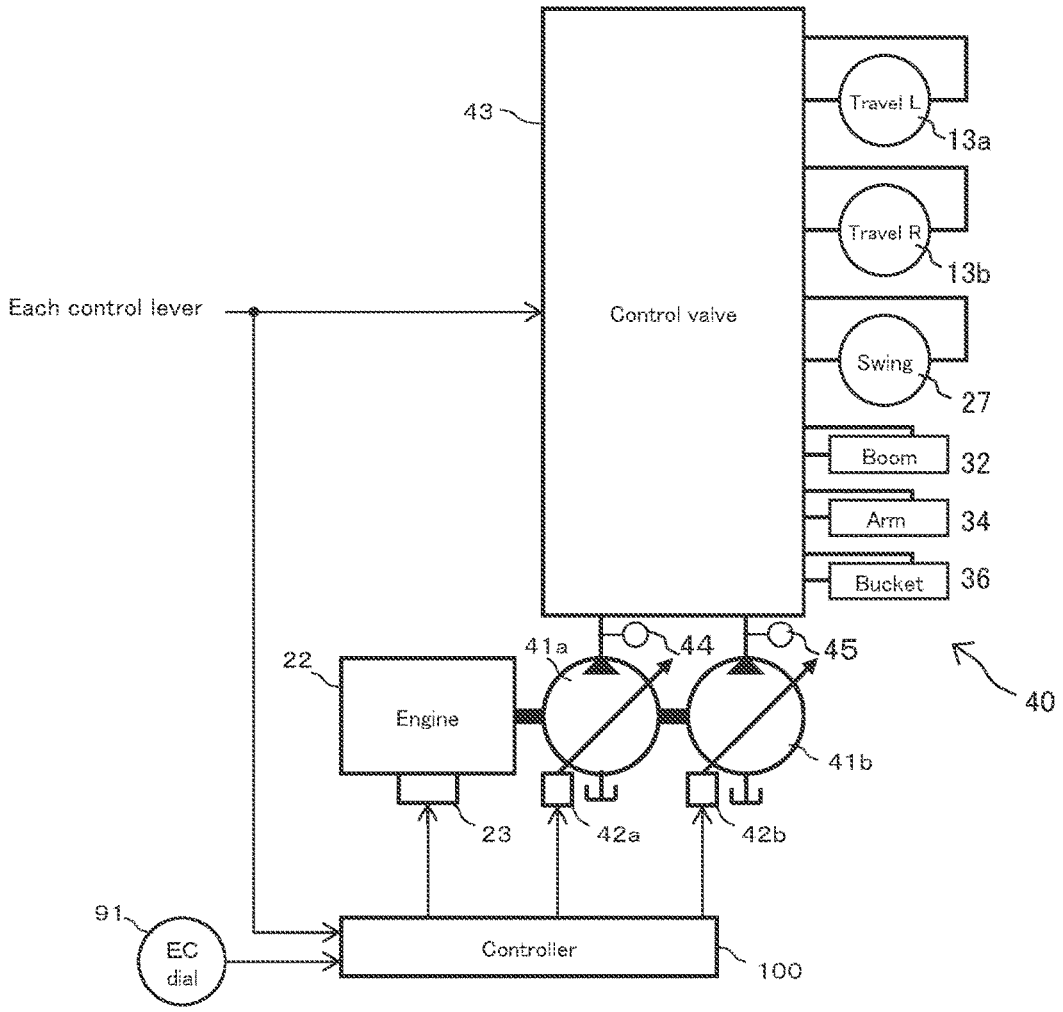
FIG. 2 is a conceptual diagram illustrating the system configuration of the hydraulic excavator which is the embodiment of the work machine according to the invention.

FIG. 2 is a conceptual diagram illustrating the system configuration of the hydraulic excavator which is the embodiment of the work machine according to the invention. As illustrated in FIG. 2, the hydraulic system 40 includes first and second hydraulic pumps 41*a* and 41*b*, both being of the variable displacement type; their associated regulators 42*a* and 42*b*; a control valve 43 for supplying the hydraulic fluid discharged from these hydraulic pumps to the hydraulic actuators by controlling the flow rate and direction of the fluid; and the hydraulic actuators including the hydraulic travel motors 13*a* and 13*b*, the hydraulic swing motor 27, the boom cylinder 32, the arm cylinder 34, and the bucket cylinder 36.

The overall system of the hydraulic excavator includes the above-described hydraulic system 40; the engine 22 that drives the first and second hydraulic pumps 41*a* and 41*b*; an engine controller 23; an EC dial 91, and a controller 100.

Rotationally driven by the engine 22, the first hydraulic pump 41*a* and the second hydraulic pump 41*b* discharge the hydraulic fluid at an amount proportional to the product of its rotational speed and volume. The discharge pipe of the first hydraulic pump 41*a* is connected with the boom cylinder 32, the arm cylinder 34, the bucket cylinder 36, the right hydraulic travel motor 13*a*, and the hydraulic swing motor 27. The discharge pipe of the second hydraulic pump 41*b* is connected with the boom cylinder 32, the arm cylinder 34, the left hydraulic travel motor 13*a*, and the hydraulic swing motor 27.

A pressure sensor 44 is provided in the discharge pipe of the first hydraulic pump 41*a* to detect the discharge pressure Pa of the first hydraulic pump 41*a* while a pressure sensor 45 is provided in the discharge pipe of the second hydraulic pump 41*b* to detect the discharge pressure Pb of the second hydraulic pump 41*b*. Signals detected by these pressure sensors 44 and 45 are input to the controller 100.

The first hydraulic pump 41*a* and the second hydraulic pump 41*b* include the regulators 42*a* and 42*b*, respectively. The regulators 42*a* and 42*b* are driven by commands from the controller 100 to change the volumes of the first hydraulic pump 41*a* and the second hydraulic pump 41*b*.

The control valve 43 is driven by the operation levers, not illustrated, provided for the hydraulic actuators including the hydraulic travel motors 13*a* and 13*b*, the hydraulic swing motor 27, the boom cylinder 32, the arm cylinder 34, and the bucket cylinder 36. The control valve 43 adjusts the flow rates at which the hydraulic fluid flows from the first hydraulic pump 41*a* and the second hydraulic pump 41*b* to the hydraulic actuators and the flow rates at which the hydraulic fluid flows from the hydraulic actuators to a hydraulic fluid tank (not illustrated).

The engine controller 23 receives a target engine speed from the controller 100 and adjusts an amount and a timing of fuel injection to the engine 22 such that the actual engine speed matches the target engine speed.

Figure 3:
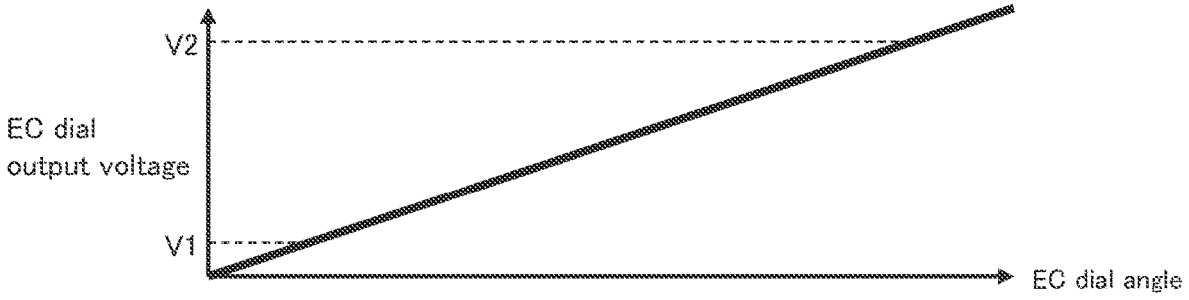
FIG. 3 is a characteristic diagram illustrating the output voltage characteristics of an EC dial of the work machine according to the embodiment of the invention.

The EC dial 91 is the device with which the operator instructs an engine speed, and its output voltage changes according to dial angles set by the operator. The output voltage is input to the controller 100. FIG. 3 is a characteristic diagram illustrating the output voltage characteristics of the EC dial of a work machine according to an embodiment of the invention. As can be seen from FIG. 3, the output voltage of the EC dial increases in proportion to increases in the dial angle of the EC dial. In FIG. 3, V1 denotes the output voltage corresponding to the later-described minimum speed N1 of the engine while V2 denotes the output voltage corresponding to the maximum speed N2 of the engine.

The controller 100 receives the output voltage of the EC dial 91, the operation amounts of the operation levers, not illustrated, provided for the hydraulic actuators, the discharge pressure Pa of the first hydraulic pump 41*a* detected by the pressure sensor 44, and the discharge pressure Pb of the second hydraulic pump 41*b* detected by the pressure sensor 45. Based on these input signals, the controller 100 computes command signals for the engine controller 23 and the regulators 42*a* and 42*b* and outputs the obtained signals thereto, thereby controlling the speed of the engine 22 and the discharge flow rates of the first hydraulic pump 41*a* and the second hydraulic pump 41*b*.

Figure 4:
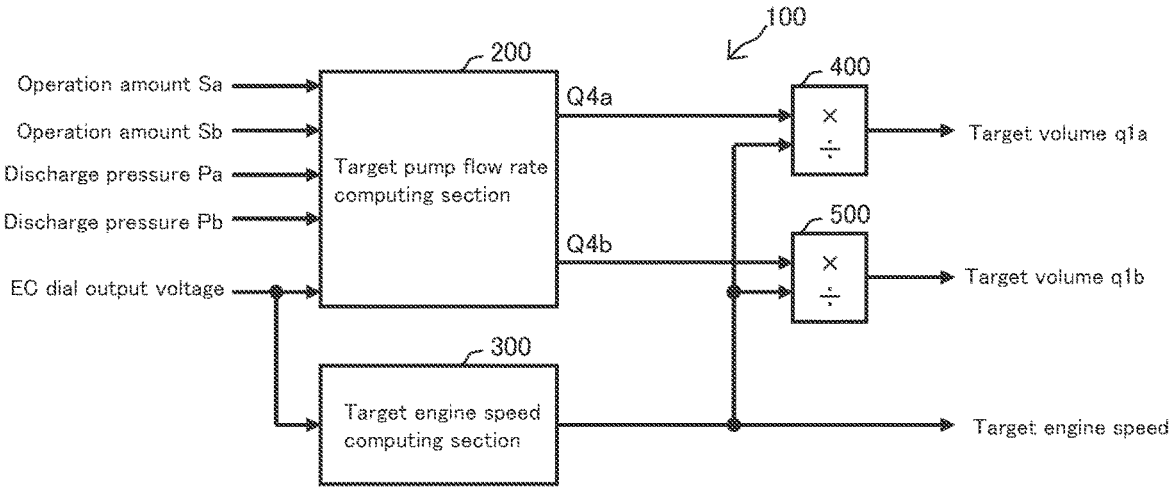
FIG. 4 is a control block diagram illustrating the computing sections of a controller of the work machine according to the embodiment of the invention.
Figure 5:
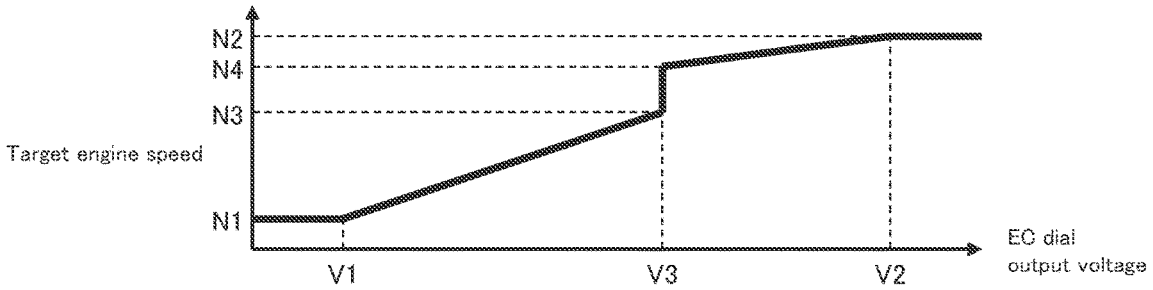
FIG. 5 is a characteristic diagram illustrating an example of a table used in a target engine speed computing section of the controller of the work machine according to the embodiment of the invention.

The control performed by the controller 100 will next be described with reference to the drawings. FIG. 4 is a control block diagram illustrating computing sections of the controller of the work machine according to the embodiment of the invention. FIG. 5 is a characteristic diagram illustrating an example of a table used in a target engine speed computing section of the controller of the work machine according to the embodiment of the invention.

As illustrated in FIG. 4, the controller 100 includes a target pump flow rate computing section 200, a target engine speed computing section 300, a first divider 400, and a second divider 500.

The target pump flow rate computing section 200 receives the following signals: a signal Sa indicative of the maximum operation amount among the operation amounts of the operation levers for operating the hydraulic actuators (the boom cylinder 32, the arm cylinder 34, the bucket cylinder 36, the right hydraulic travel motor 13*a*, and the hydraulic swing motor 27) connected with the discharge pipe of the first hydraulic pump 41*a*; a signal Sb indicative of the maximum operation amount among the operation amounts of the operation levers for operating the hydraulic actuators (the boom cylinder 32, the arm cylinder 34, the left hydraulic travel motor 13*a*, and the hydraulic swing motor 27) connected with the discharge pipe of the second hydraulic pump 41*b*; the discharge pressure Pa of the first hydraulic pump 41*a*; the discharge pressure Pb of the second hydraulic pump 41*b*; and the output voltage of the EC dial. Based on these signals, the target pump flow rate computing section 200 computes a target flow rate Q4*a* of the first hydraulic pump 41*a* and a target flow rate Q4*b* of the second hydraulic pump 41*b*. The target flow rate Q4*a* of the first hydraulic pump 41*a* is output to the first divider 400 while the target flow rate Q4*b* of the second hydraulic pump 41*b* is output to the second divider 500. The computations performed by the target pump flow rate computing section 200 will later be described in detail.

The target engine speed computing section 300 receives the output voltage of the EC dial, determines a target engine speed based on a preset table, and outputs the target engine speed to the first divider 400, the second divider 500, and the engine controller 23.

As illustrated in FIG. 5, the target engine speed computing section 300 outputs the minimum speed N1 of the engine 22 as the target engine speed when the output voltage of the EC dial is equal to or less than V1. As the output voltage of the EC dial increases from V1 to V3, the output value indicative of the target engine speed increases from N1 to N3. When the output voltage of the EC dial exceeds V3 by any amount, the output value turns to N4. As the output voltage of the EC dial increases from V3 to V2, the output value increases from N4 to N2. When the output voltage of the EC dial is equal to or greater than V2, the target engine speed computing section 300 outputs the maximum speed N2.

If mechanical resonance frequencies exist between the minimum speed N1 and maximum speed N2 of the engine 22, N3 and N4 are set such that the resonance frequencies lie between N3 and N4. By doing so, the target engine speed does not stay between N3 and N4, and resonance is less likely to occur.

Figure 18:
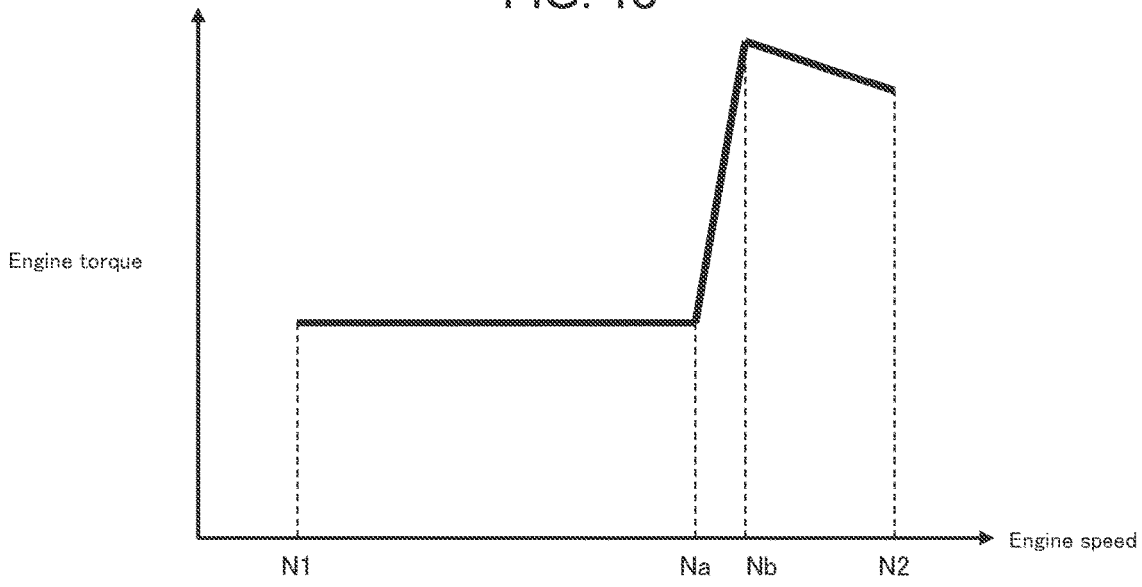
FIG. 18 is a characteristic diagram of an engine having speed-torque characteristics in which a speed decreases causes a drastic torque decreases in a particular speed range.

Similar to the speed-torque characteristics shown in FIG. 18, when speed-torque characteristics of the engine 22 have a speed range (the range from Na to Nb), in which a speed decrease result in a drastic torque decrease, between the minimum speed N1 and the maximum speed N2, N3 is set to a value equal to Na or less than Na to ensure a margin and N4 is set to a value equal to Nb or less than Nb to ensure a margin. By doing so, the target engine speed does not stay between N3 and N4, and the engine is less prone to lug down.

Referring back to FIG. 5, the present embodiment is characterized in that the ratio of a change in the target engine speed to the change in the EC dial output voltage when the EC dial output voltage increases from V3 to V2 (i.e., (N2-N4)/(V2-V3)) is made smaller than the ratio of a change in the target engine speed to the change in the EC dial output voltage when the EC dial output voltage increases from V1 to V3 (i.e., (N3-N1)/(V3-V1)). This allows fine adjustments of the engine speed in a high speed range where the output power of the work machine is high.

Referring again to FIG. 4, the first divider 400 receives the target flow rate Q4*a* of the first hydraulic pump 41*a* computed by the target pump flow rate computing section 200 and the target engine speed computed by the target engine speed computing section 300. The first divider 400 divides the target flow rate Q4*a* by the target engine speed to calculate a target volume q1*a* for the first hydraulic pump 41*a*. Based on the target volume q1*a*, the first divider 400 outputs a command signal to the regulator 42*a* to control the first hydraulic pump 41*a*. As a result, the discharge flow rate of the first hydraulic pump 41*a* is made substantially equal to Q4*a*.

The second divider 500 receives the target flow rate Q4*b* of the second hydraulic pump 41*b* computed by the target pump flow rate computing section 200 and the target engine speed computed by the target engine speed computing section 300. The second divider 500 divides the target flow rate Q4*b* by the target engine speed to calculate a target volume q1*b* for the second hydraulic pump 41*b*. Based on the target volume q1*b*, the second divider 500 outputs a command signal to the regulator 42*b* to control the second hydraulic pump 41*b* . As a result, the discharge flow rate of the second hydraulic pump 41*b* is made substantially equal to Q4*b*.

Figure 6:
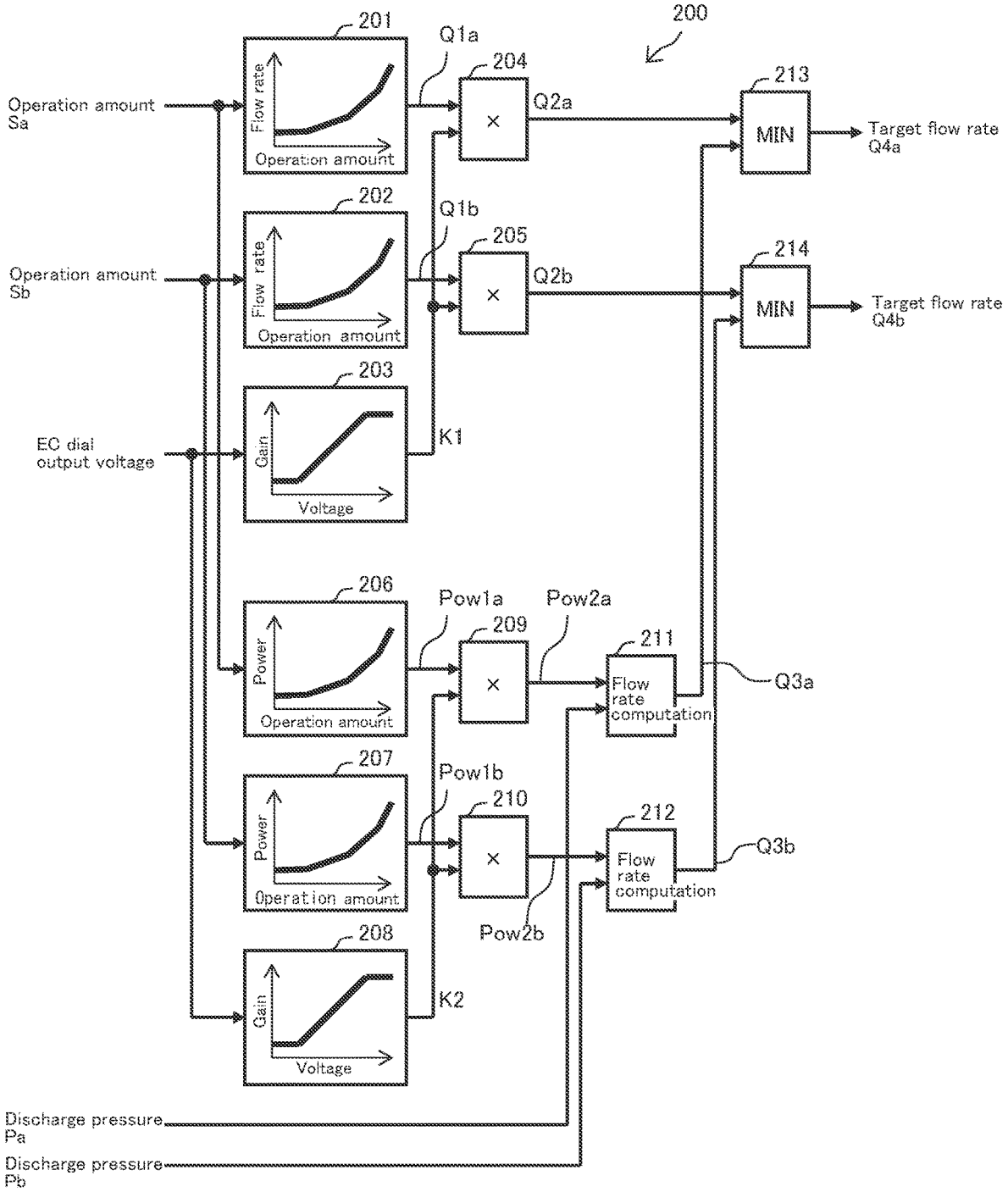
FIG. 6 is a control block diagram illustrating a target pump flow rate computing section of the controller of the work machine according to the embodiment of the invention.

With reference to FIG. 6, the target pump flow rate computing section 200 now will be described in detail. FIG. 6 is a control block diagram illustrating the target pump flow rate computing section of the controller of the work machine according to the embodiment of the invention. As illustrated in FIG. 6, the target pump flow rate computing section 200 includes first to third function generators 201 to 203; a first multiplier 204; a second multiplier 205; fourth to sixth function generators 206 to 208; a third multiplier 209; a fourth multiplier 210; a first flow rate calculator 211; a second flow rate calculator 212; a first minimum selector 213; and a second minimum selector 214.

The first function generator 201 receives the signal Sa indicative of the maximum operation amount among the operation amounts of the operation levers for operating the hydraulic actuators connected with the discharge pipe of the first hydraulic pump 41*a*. The first function generator 201 computes a flow rate signal Q1*a* based on a preset table and outputs it to the first multiplier 204. The table is determined by using as a reference the target flow rate of the first hydraulic pump 41*a* versus the operation amount signal Sa when the engine 22 is operated at the maximum speed and the discharge pressure of the first hydraulic pump 41*a* is low. The table is set such that as the operation amount signal Sa increases, the target flow rate signal Q1*a* increases accordingly.

The second function generator 202 receives the signal Sb indicative of the maximum operation amount among the operation amounts of the operation levers for operating the hydraulic actuators connected with the discharge pipe of the second hydraulic pump 41*b*. By performing a computation similar to that performed by the first function generator 201, the second function generator 202 computes a target flow rate signal Q1*b* for the second hydraulic pump 41*b* and outputs it to the second multiplier 205.

Figure 7:
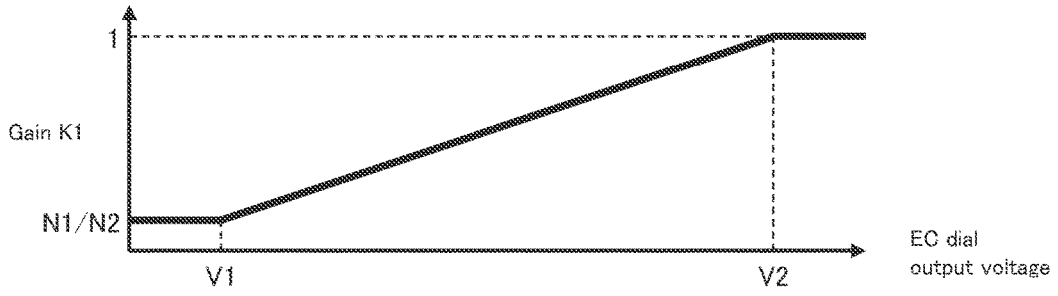
FIG. 7 is a characteristic diagram illustrating an example of a gain table (K1) used in the target pump flow rate computing section of the controller of the work machine according to the embodiment of the invention.

The third function generator 203 receives the EC dial output voltage, computes a gain signal K1 based on a preset table, and outputs it to the first multiplier 204 and the second multiplier 205. FIG. 7 is a characteristic diagram illustrating an example of a gain table (K1) used in the target pump flow rate computing section of the controller of the work machine according to the embodiment of the invention. As illustrated in FIG. 7, the table is set such that when the EC dial output voltage is equal to or less than V1, the gain K1 is the ratio of the minimum speed N1 to the maximum speed N2 of the engine 22, that is, the ratio N1/N2, such that when the EC dial output voltage increases from V1 to V2, the gain K1 increases continuously, and such that when the EC dial output voltage is equal to or greater than V2, the gain K is 1.

Figure 8:
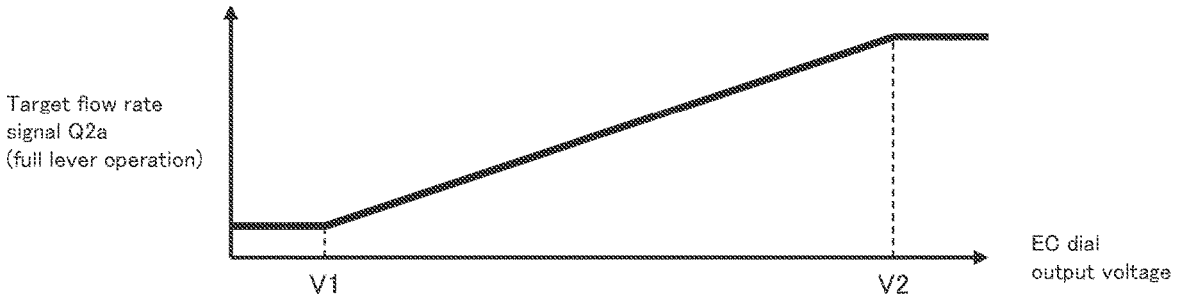
FIG. 8 is a characteristic diagram illustrating an example of a target flow rate signal Q2*a* calculated in the target pump flow rate computing section of the controller of the work machine according to the embodiment of the invention.

Referring again to FIG. 6, the first multiplier 204 receives the target flow rate signal Q1*a* and the gain K1, multiplies them to calculate a target flow rate signal Q2*a* for the first hydraulic pump 41*a*, and outputs it to the first minimum selector 213. FIG. 8 is a characteristic diagram illustrating an example of the target flow rate signal Q2*a* computed by the target pump flow rate computing section of the controller of a work machine according to an embodiment of the invention. FIG. 8 show the target flow rate signal Q2*a* that is the result obtained by multiplying the output of the third function generator 203 by the output of the first function generator 201 at the time when the operation amount signal Sa is the maximum, that is, at the time of a full lever operation. Thus, the characteristics are similar to the characteristics of the gain K1 shown in FIG. 7.

Referring back to FIG. 6, the second multiplier 205 receives the target flow rate signal Q1*b* and the gain K1. By performing a computation similar to that performed by the first multiplier 204, the second multiplier 205 computes a target flow rate signal Q2*b* for the second hydraulic pump 41*b* and outputs it to the second minimum selector 214.

The fourth function generator 206 receives the signal Sa indicative of the maximum operation amount among the operation amounts of the operation levers for operating the hydraulic actuators connected with the discharge pipe of the first hydraulic pump 41*a*. The fourth function generator 206 computes a target output power signal Pow1*a* based on a preset table and outputs it to the third multiplier 209. The table is determined by using as a reference the target output power of the first hydraulic pump 41*a* versus the operation amount signal Sa when the engine 22 is operated at the maximum speed. The table is set such that as the operation amount signal Sa increases, the target output power signal Pow1*a* increases accordingly.

The fifth function generator 207 receives the operation amount signal Sb, performs a computation similar to that performed by the fourth function generator 206 to calculate a target output power signal Pow1*b* for the second hydraulic pump 41*b*, and outputs it to the fourth multiplier 210.

Figure 9:
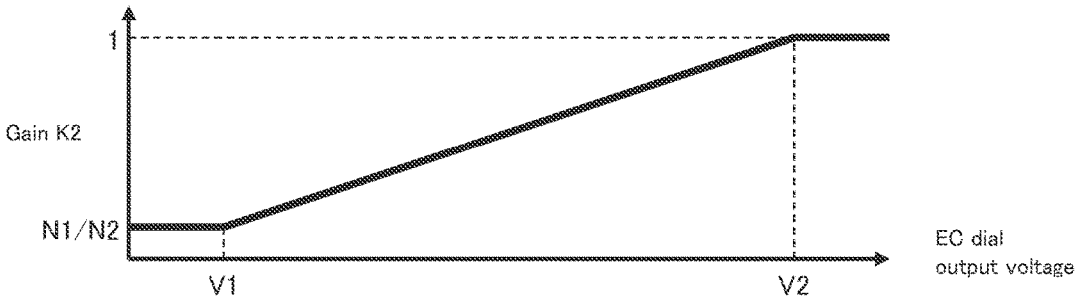
FIG. 9 is a characteristic diagram illustrating an example of a gain table (K2) used in the target pump flow rate computing section of the controller of the work machine according to the embodiment of the invention.

The sixth function generator 208 receives the EC dial output voltage, computes a gain signal K2 based on a preset table, and outputs it to the third multiplier 209 and the fourth multiplier 210. FIG. 9 is a characteristic diagram illustrating an example of a gain table (K2) used in the target pump flow rate computing section of the controller of the work machine according to the embodiment of the invention. As illustrated in FIG. 9, the table is set such that when the EC dial output voltage is equal to or less than V1, the gain K2 is the ratio of the minimum speed N1 to the maximum speed N2 of the engine 22, that is, the ratio N1/N2, such that when the EC dial output voltage increases from V1 to V2, the gain K2 increases continuously, and such that when the EC dial output voltage is equal to or greater than V2, the gain K2 is 1. The characteristics of the gain K2 increasing in the region where the EC dial output voltage increases from V1 to V2 can be similar to the characteristics of the gain K1 shown in FIG. 7; however, they can be different in consideration of the torque characteristics of the engine 22.

Figure 10:
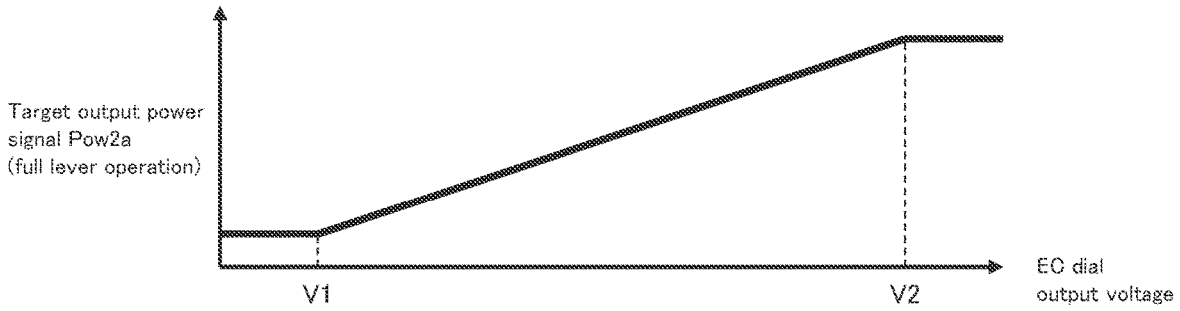
FIG. 10 is a characteristic diagram illustrating an example of a target output power signal Pow2*a* calculated in the target pump flow rate computing section of the controller of the work machine according to the embodiment of the invention.

Referring again to FIG. 6, the third multiplier 209 receives the target output power signal Pow1*a* and the gain K2, multiplies them to calculate a target output power signal Pow2*a* for the first hydraulic pump 41*a*, and outputs it to the first flow rate calculator 211. FIG. 10 is a characteristic diagram illustrating an example of the target output power signal Pow2*a* computed by the target pump flow rate computing section of the controller of the work machine according to the embodiment of the invention. FIG. 10 shows the target output power signal Pow2*a* that is the result obtained by multiplying the output of the sixth function generator 208 by the output of the fourth function generator 206 at the time when the operation amount signal Sa is the maximum, that is, at the time of a full lever operation. Thus, the characteristics are similar to the characteristics of the gain K2 shown in FIG. 9.

Referring again to FIG. 6, the fourth function generator 210 receives the target output power signal Pow1*b* and the gain K2, performs a computation similar to that performed by the third function generator 209 to calculate a target output power signal Pow2*b* for the second hydraulic pump 41*b*, and outputs it to the second flow rate calculator 212.

The first flow rate calculator 211 receives the target output power signal Pow2*a* and the discharge pressure signal Pa of the first hydraulic pump 41*a*, divides the target output power signal Pow2*a* by the discharge pressure signal Pa to calculate a target flow rate signal Q3*a* for the first hydraulic pump 41*a*, and outputs it to the first minimum selector 213.

The second flow rate calculator 212 receives the target output power signal Pow2*b* and the discharge pressure signal Pb of the second hydraulic pump 41*b*, divides the target output power signal Pow2*b* by the discharge pressure signal Pb to calculate a target flow rate signal Q3*b* for the second hydraulic pump 41*b*, and outputs it to the second minimum selector 214.

The first minimum selector 213 receives the target flow rate signal Q2*a* computed by the first multiplier 204 and the target flow rate signal Q3*a* computed by the first flow rate calculator 211, selects the smaller of the two as a target flow rate Q4*a* for the first hydraulic pump 41*a*, and outputs it to the first divider 400 shown in FIG. 4.

The second minimum selector 214 receives the target flow rate signal Q2*b* computed by the second multiplier 205 and the target flow rate signal Q3*b* computed by the second flow rate calculator 212, selects the smaller of the two as a target flow rate Q4*b* for the second hydraulic pump 41*b*, and outputs it to the second divider 500 shown in FIG. 4.

In FIG. 6, when the discharge pressure signal Pa of the first hydraulic pump 41*a* is low, the target flow rate signal Q3*a* computed by the first flow rate calculator 211 is larger than the target flow rate signal Q2*a* computed by the first multiplier 204. In that case, the target flow rate signal Q2*a* is output as the target flow rate Q4*a* via the first minimum selector.

Figure 11:
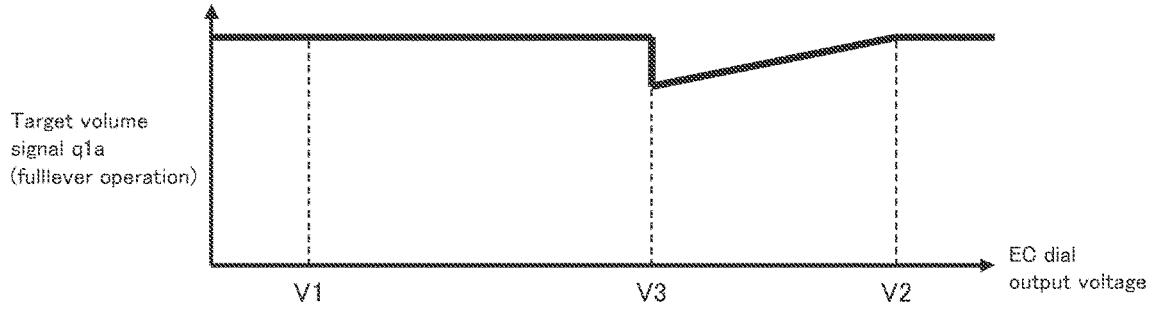
FIG. 11 is a characteristic diagram illustrating an example of a target pump volume q1*a* at the time of a full lever operation calculated in the controller of the work machine according to the embodiment of the invention.

When the target flow rate signal Q2*a* exhibits the characteristics shown in FIG. 8, the target volume q1*a* in FIG. 4 to be computed by the controller 100 is calculated by the first divider 400 dividing the characteristics of the target flow rate signal Q2*a* shown in FIG. 8 by the output characteristics shown in FIG. 5 from the target engine speed computing section 300. FIG. 11 is a characteristic diagram illustrating an example of the target pump volume q1*a* at the time of a full lever operation computed by the controller of the work machine according to the embodiment of the invention. Based on the target volume signal q1*a* shown in FIG. 11, the controller 100 outputs a command signal to the regulator 42*a*. As a result, the discharge flow rate of the first hydraulic pump 41*a* is made substantially equal to the target flow rate signal shown in FIG. 8.

In the present embodiment, the output characteristics illustrated in FIG. 5 from the target engine speed computing section 300 are such that the ratio of the change in the target engine speed to the change in the EC dial output voltage when the EC dial output voltage increases from V3 to V2 is made smaller than the ratio of the change in the target engine speed to the change in the EC dial output voltage when the EC dial output voltage increases from V1 to V3. Thus, even if there is a region where the increase rate of the target engine speed is small such as the increase section from V3 to V2, increase rate of the target flow rate signal can be controlled to be equal in the section between V1 and V3 of the EC dial output voltage and in the section between V3 and V2, as shown in FIG. 8.

Further, in FIG. 6, when the discharge pressure signal Pa of the first hydraulic pump 41*a* is high, the target flow rate signal Q3*a* computed by the first flow rate calculator 211 is smaller than the target flow rate signal Q2*a* computed by the first multiplier 204. Thus, the target flow rate signal Q3*a* is output as the target flow rate Q4*a*via the first minimum selector. In that case, the increase rate of the target output power signal can be controlled to be equal in the section between V1 and V3 of the EC dial output voltage and in the section between V3 and V2, as shown in FIG. 10.

According to the work machine according to the embodiment of the present invention described above, resonance and engine lug down are less likely to occur even if there is a mechanical resonance-inducing speed range or a speed range where an engine speed decrease results in a drastic torque decrease between a minimum speed and a maximum speed of the engine speed. Further, since the engine speed can be finely adjusted in a speed range higher than a particular engine speed, it is possible to improve work efficiency in the speed range frequently used in the work machine.

Figure 12:
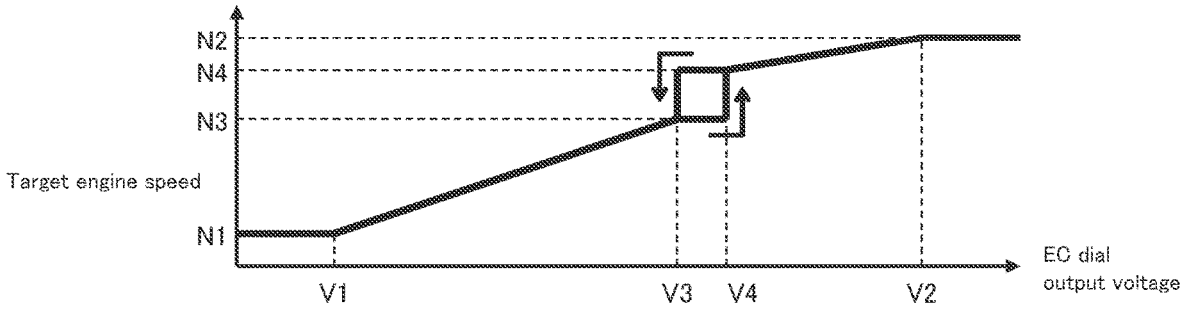
FIG. 12 is a characteristic diagram illustrating another example of a table used in the target engine speed computing section of the controller of the work machine according to the embodiment of the invention.

When the table of the target engine speed computing section illustrated in FIG. 5 (the characteristics of the target engine speed versus the EC dial output voltage) is used, the target engine speed may exhibit oscillatory behavior between N3 and N4 if, for example, some noise is superimposed on the EC dial output voltage when the voltage is near V3. To prevent such behavior of the target engine speed, it is possible to provide hysteresis for the EC dial output voltage. FIG. 12 is a characteristic diagram illustrating another example of a table used in the target engine speed computing section of the controller of the work machine according to the embodiment of the invention.

The characteristics in FIG. 12 is obtained by adding to the characteristic diagram in FIG. 5 a voltage V4 that is higher than the EC dial output voltage V3 by a hysteresis voltage. When the EC dial output voltage is equal to or less than V1, the minimum speed N1 of the engine 22 is output as the target engine speed. As the EC dial output voltage increases from V1 to V3, the output value indicative of the target engine speed increases from N1 to N3. Even when the EC dial output voltage exceeds V3, the output value indicative of the target engine speed stays at N3 until the EC dial output voltage reaches V4. After the EC dial output voltage exceeds V4 by any amount, the output value becomes N4. As the EC dial output voltage increases from V3 to V2, the output value increases from N4 to N2.

Conversely, when the EC dial output voltage decreases from V2 to V4, the output value indicative of the target engine speed decreases from N2 to N4. Even when the EC dial output voltage falls below V4, the output value indicative of the target engine speed stays at N4 until the EC dial output voltage reaches V3. After the EC dial output voltage falls below V3 by any amount, the output value becomes N3. As the EC dial output voltage decreases from V3 to V1, the output value decreases from N3 to N1.

Figure 13:
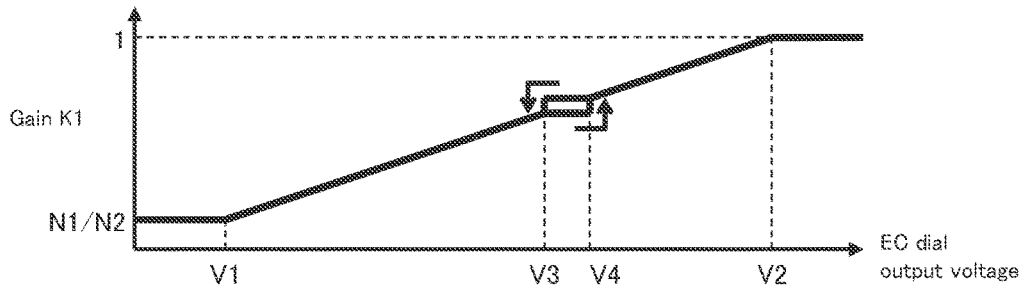
FIG. 13 is a characteristic diagram illustrating another example of the gain table (K1) used in the target pump flow rate computing section of the controller of the work machine according to the embodiment of the invention.
Figure 14:
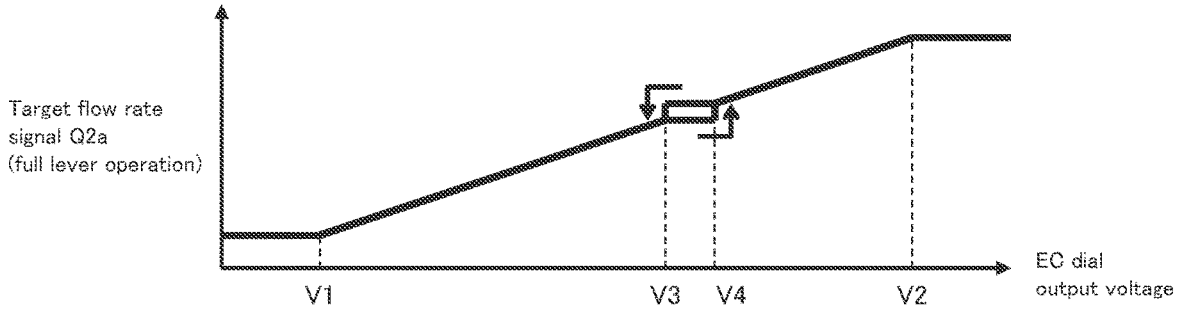
FIG. 14 is a characteristic diagram illustrating another example of the target flow rate signal Q2*a* calculated in the target pump flow rate computing section of the controller of the work machine according to the embodiment of the invention.
Figure 15:
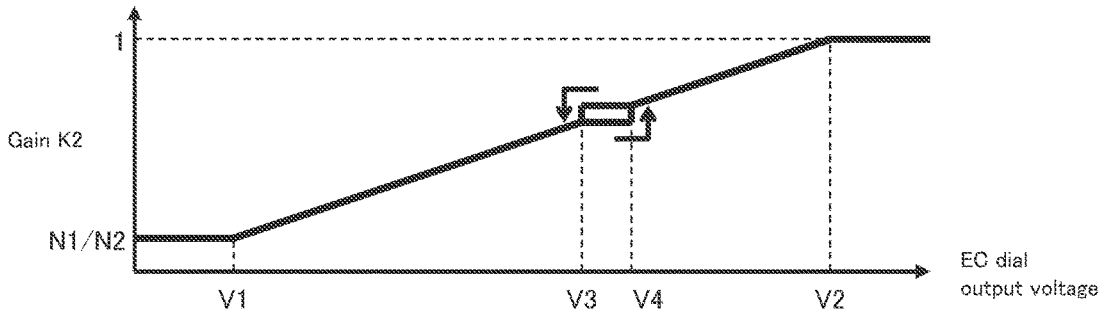
FIG. 15 is a characteristic diagram illustrating another example of the gain table (K2) used in the target pump flow rate computing section of the controller of the work machine according to the embodiment of the invention.
Figure 16:
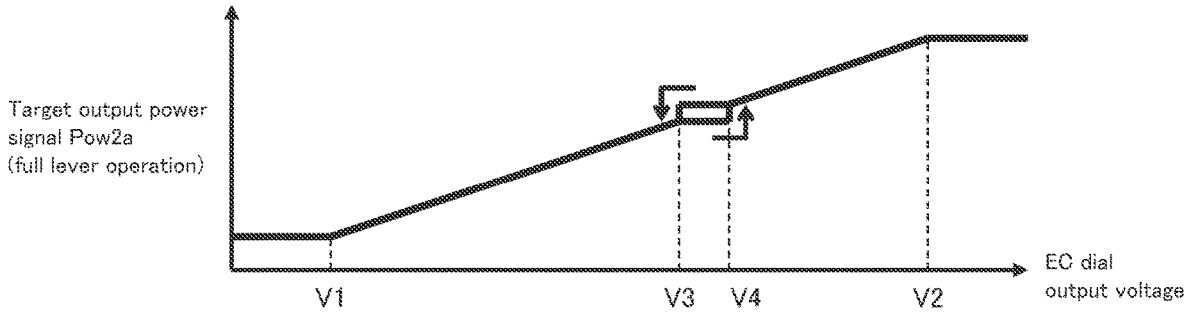
FIG. 16 is a characteristic diagram illustrating another example of the target output power signal Pow2*a* calculated in the target pump flow rate computing section of the controller of the work machine according to the embodiment of the invention.
Figure 17:
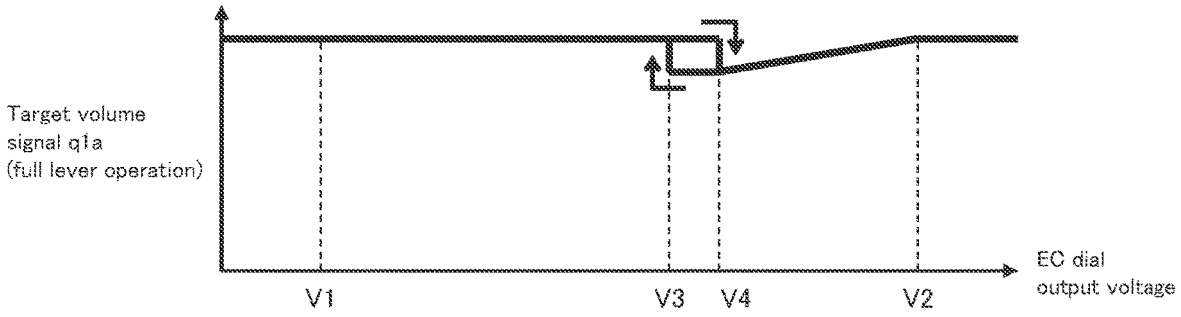
FIG. 17 is a characteristic diagram illustrating another example of the target pump volume q1*a* at the time of a full lever operation calculated in the controller of the work machine according to the embodiment of the invention.

As described above, when hysteresis characteristics are added to the table used by the target engine speed computing section of the controller, the characteristics of the computing sections of the controller illustrated in FIGS. 7 through 11 also are set to include the hysteresis characteristics. FIGS. 13 through 17 illustrate each of the characteristics including such hysteresis characteristics as another example. FIG. 13 is a characteristic diagram illustrating another example of a gain table (K1) used in the target pump flow rate computing section of the controller of the work machine according to the embodiment of the invention. FIG. 14 is a characteristic diagram illustrating another example of the target flow rate signal Q2*a* computed by the target pump flow rate computing section of the controller of the work machine according to the embodiment of the invention. FIG. 15 is a characteristic diagram illustrating another example of a gain table (K2) used in the target pump flow rate computing section of the controller of the work machine according to the embodiment of the invention. FIG. 16 is a characteristic diagram illustrating another example of the target output power signal Pow2*a* computed by the target pump flow rate computing section of the controller of the work machine according to the embodiment of the invention. FIG. 17 is a characteristic diagram illustrating another example of the target pump volume q1*a* at the time of a full lever operation computed by the controller of the work machine according to the embodiment of the invention.

As illustrated in FIGS. 13 and 15, hysteresis characteristics are added to the gain tables (K1 and K2) of the target pump flow rate computing section. By doing so, the target flow rate signal Q2 at the time of a full lever operation, the target output power signal Pow2*a*, and the target pump volume q1*a* in the controller each exhibit the characteristics of FIGS. 14, 16, and 17.

While we have described a case where the invention is applied to a hydraulic excavator, the invention is not limited thereto. The invention is applicable to any work machine as long as the operator can specify an engine speed using an engine speed instructing device such as an EC dial or the like.

DESCRIPTION OF REFERENCE CHARACTERS

10: Lower travel structure
13: Hydraulic travel motor
20: Upper swing structure
21: Swing frame
22: Engine
23: Engine controller
26: Decelerating mechanism
27: Hydraulic swing motor
30: Excavating mechanism
31: Boom
32: Boom cylinder
33: Arm
34: Arm cylinder
35: Bucket
36: Bucket cylinder
40: Hydraulic system
41*a*: First hydraulic pump
41*b*: Second hydraulic pump
42*a*, 42*b*: Regulator
43: Control valve
91: EC dial
100: Controller
200: Target pump flow rate computing section
300: Target engine speed computing section

The invention claimed is:

1. A work machine comprising:

an engine;

a hydraulic pump driven by the engine;

a hydraulic actuator driven by hydraulic fluid discharged from the hydraulic pump;

an engine speed instructing device for an operator to instruct a target engine speed for the engine;

an operation device for operating the hydraulic actuator; and a control device for controlling an engine speed of the engine, wherein the control device includes:

a target engine speed computing section for detecting an operation amount of the engine speed instructing device and computing the target engine speed based on target engine speed characteristics preset from the detected operation amount of the engine speed instructing device; and a target pump flow rate computing section for receiving an operation amount of the operation device and the operation amount of the engine speed instructing device and computing a target flow rate for the hydraulic pump based on the received operation amounts of the operation device and the engine speed instructing device, wherein the target engine speed characteristics are such that the target engine speed can be set excluding a range between a first engine speed and a second engine speed, the first engine speed being higher than a minimum speed of the engine and lower than a maximum speed of the engine, the second engine speed being higher than the first engine speed and lower than the maximum speed of the engine, wherein a ratio of a change in the target engine speed to a change in the operation amount of the engine speed instructing device when the operation amount of the engine speed instructing device is changed from an operation amount for instructing the minimum speed to an operation amount for instructing the first engine speed is larger than a ratio of a change in the target engine speed to a change in the operation amount of the engine speed instructing device when the operation amount of the engine speed instructing device is changed from an operation amount for instructing the second engine speed to an operation amount for instructing the maximum speed, and wherein the target pump flow rate computing section computes the target flow rate of the hydraulic pump such that a ratio of a change in the discharge flow rate of the hydraulic pump to the change in the operation amount of the engine speed instructing device when the operation amount of the engine speed instructing device is changed from the operation amount for instructing the minimum speed to the operation amount for instructing the first engine speed becomes equal to a ratio of a change in a discharge flow rate of the hydraulic pump to the change in the operation amount of the engine speed instructing device when the operation amount of the engine speed instructing device is changed from the operation amount for instructing the second engine speed to the operation amount for instructing the maximum speed.

2. The work machine according to claim 1, further comprising a pressure sensor for detecting a discharge pressure of the hydraulic pump, wherein the control device includes the target pump flow rate computing section for receiving the operation amount of the operation device, the discharge pressure of the hydraulic pump detected by the pressure sensor, and the operation amount of the engine speed instructing device and computing a target flow rate for the hydraulic pump based on the received operation amount of the operation device, the received discharge pressure of the hydraulic pump, and the received operation amount of the engine speed instructing device, and wherein the target pump flow rate computing section computes the target flow rate of the hydraulic pump such that a ratio of a change in an output power of the hydraulic pump to the change in the operation amount of the engine speed instructing device when the operation amount of the engine speed instructing device is changed from the operation amount for instructing the minimum speed to the operation amount for instructing the first engine speed becomes equal to a ratio of a change in the output power of the hydraulic pump to the change in the operation amount of the engine speed instructing device when the operation amount of the engine speed instructing device is changed from the operation amount for instructing the second engine speed to the operation amount for instructing the maximum speed.

* * * * *